United States Patent [19]

Raymor et al.

[11] 4,346,815

[45] Aug. 31, 1982

[54] FROZEN FOOD CONTAINER

[75] Inventors: Roger F. Raymor; Les Adams, both of Toledo, Ohio

[73] Assignee: Seligco Food Corporation, Brooklyn, N.Y.

[21] Appl. No.: 204,211

[22] Filed: Nov. 5, 1980

[51] Int. Cl.[3] ..... B65D 41/16; B65D 41/18

[52] U.S. Cl. ..... 220/306; 215/321

[58] Field of Search ..... 220/306, 70, 72; 215/321; 150/0.5

[56] References Cited

U.S. PATENT DOCUMENTS 3,176,868 4/1965 Crisci ..... 215/321

4,047,329 9/1977 Holt ..... 220/306 X

*Primary Examiner*—George T. Hall

*Attorney, Agent, or Firm*—Kenyon & Kenyon

[57] ABSTRACT

An improved container for storing frozen foods such as ice cream comprising a base, a cylindrical body member joined to the base, and a rim disposed on the end of the body member which includes an edge projecting radially outwardly therefrom perpendicular to the longitudinal axis of the container. A cover adapted for slidable positioning over the rim has spaced-apart annular ridges on the inner surface thereof between which the edge of the rim is received for securing the cover on the body member.

7 Claims, 6 Drawing Figures

Fig. 2.
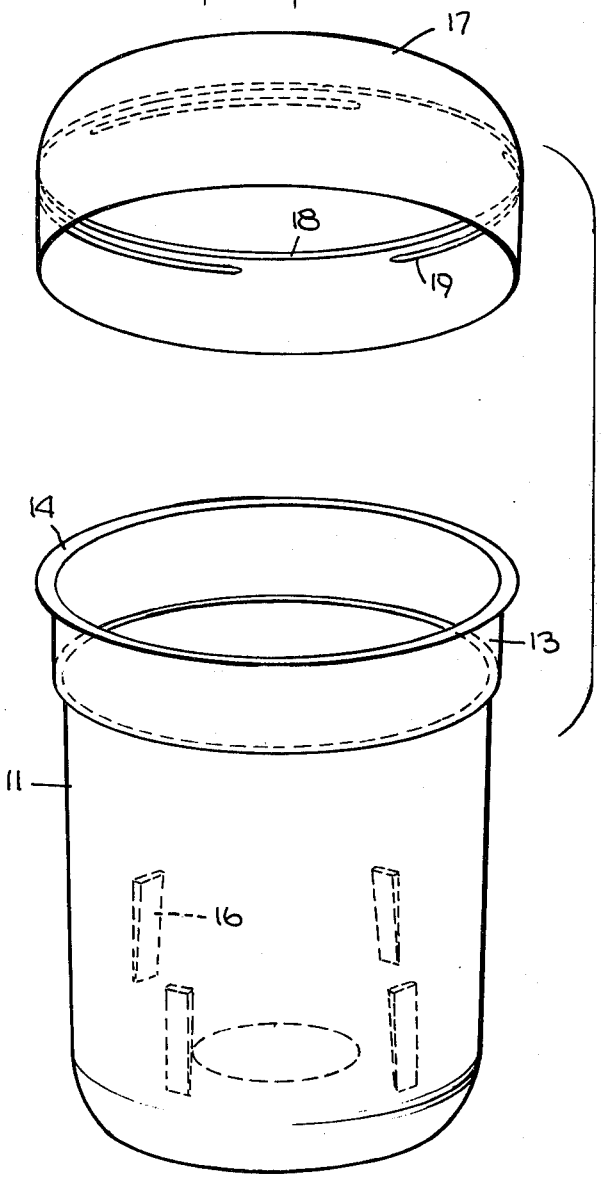
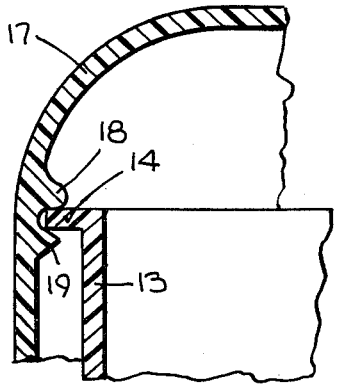
Fig. 4.

FROZEN FOOD CONTAINER

BACKGROUND OF THE INVENTION

1. Field of the Invention

This invention relates to containers, and in particular to an improved container for storing frozen foods such an ice cream and the like.

2. Description of the Prior Art

Containers for the storage of frozen foods such as ice cream have heretofore generally been fabricated of paper products, for example, cardboard, and utilize a cover which merely slides over the top of the body of the container. Such a container has the disadvantage that the cover thereof cannot be securely fastened to the container, which may result in the spillage and/or contamination of the contents of the container. Also, such containers usually lose their rigidity when the frozen contents stored therein melt, due to the absorption of some of the liquid by the cardboard from which the container is fabricated. In such a condition, the container is easily damaged and torn, thereby resulting in spillage of the contents of the container.

SUMMARY OF THE INVENTION

It is therefore an object of the present invention to provide an improved container for frozen foods and the like which overcomes the aforementioned disadvantages of heretofore known containers and which is strong and durable and has a cover which is easily removable, yet securely fastenable to the container.

It is also an object of the present invention to provide an improved container which can be integrally molded from plastic material and easily and simply manufactured.

These and other objects of the invention are achieved in a container for storing frozen foods such as ice cream and the like, comprising a base, a cylindrical body member joined to the base, and a rim disposed at the end of the cylindrical body member opposite the base which includes an edge projecting radially outwardly perpendicular to the longitudinal axis of the container. A cover is provided which is adapted for slidable positioning over the rim of the body member, and means are disposed on the inner surface of the cover and are adapted for interlocking engagement with the rim for securing the cover on the cylindrical body member.

These and other novel features and advantages of the invention will be described in further detail in the following detailed description.

BRIEF DESCRIPTION OF THE DRAWINGS

In the drawings, wherein similar reference numerals denote similar elements throughout the several views thereof:

FIG. 2 is a perspective view of the container illustrated in FIG. 1 showing the cover of the container removed therefrom;

FIG. 4 is an enlarged, partial cross-sectional view of the container illustrating the construction of the inner surface of the cover and the rim of the cylindrical body member;

DETAILED DESCRIPTION

Figure 1:
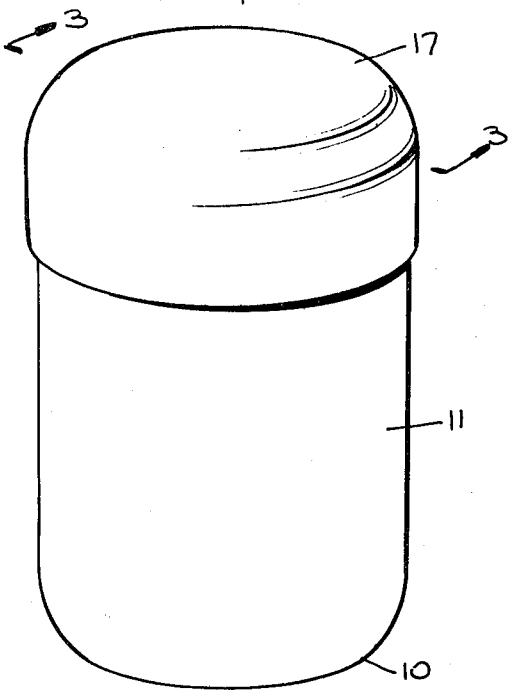
FIG. 1 is a perspective view of an improved container constructed according to the present invention.
Figure 3:
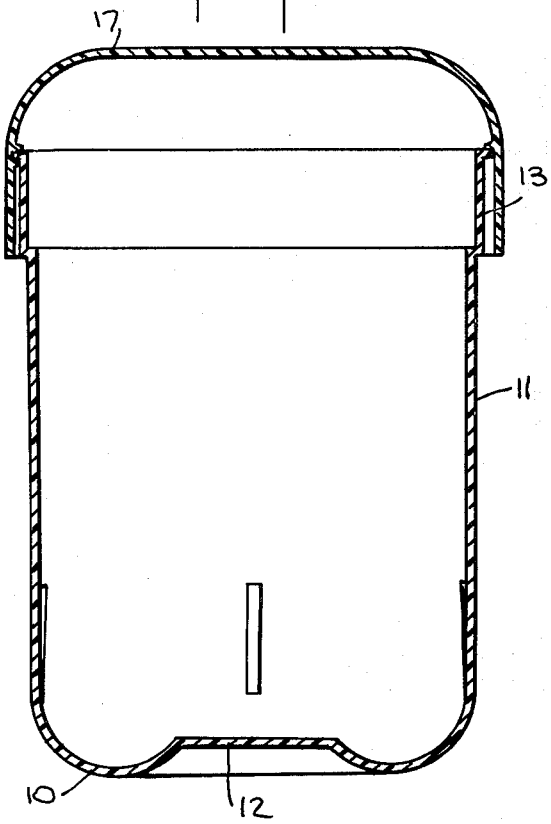
FIG. 3 is a longitudinal cross-sectional view of the container taken along section 3—3 of FIG. 1.
Figure 5:
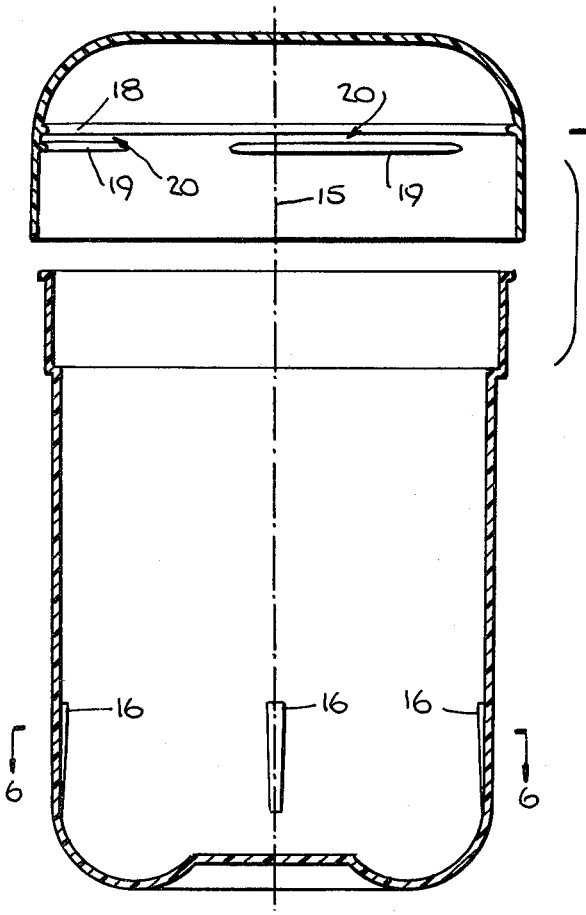
FIG. 5 is a longitudinal cross-sectional view of the container showing the cover removed therefrom.
Figure 6:
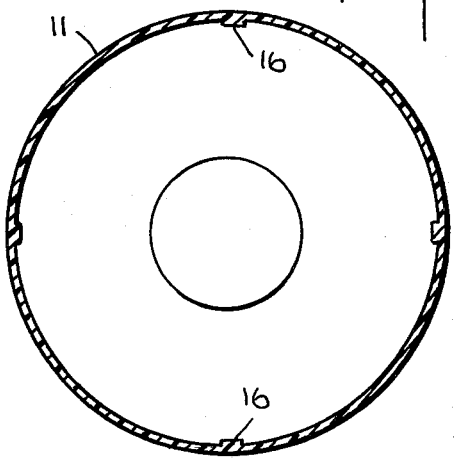
FIG. 6 is a cross-sectional view of the container taken along section 6—6 of FIG. 5.

Referring now to the drawings, there is shown a container constructed according to the present invention including a base 10 and a cylindrical body member 11 which is joined to the base. Base 10 is generally annular in shape and is curved upwardly at its radially outer edge. The base includes a central portion 12 which is inwardly recessed with respect to the bottom of the base. A rim 13 is disposed at the upper end of cylindrical body member 11 opposite the base and includes an edge 14 which projects radially outwardly from rim 13 perpendicular to the longitudinal axis of the container (illustrated by dashed line 15 in FIG. 5). In the illustrated embodiment of the invention, rim 13 has a diameter which is greater than that of the cylindrical body member 11. A plurality of vertically disposed, circumferentially spaced-apart rib members 16 are disposed on the inner surface of the cylindrical body member 11 for reinforcing the lower sides of the container and providing rigidity. Base 10, which due to recessed central portion 12 provides vertical stability to the container, rim 13 and rib members 16 are integrally formed with cylindrical body member 11 and are preferably molded from plastic material by means of an injection molding process.

The container also includes a cover 17 which is adapted for slidable positioning over rim 13 of cylindrical body member 11. Means, illustrated as a first annular ridge 18 disposed on the inner surface of cover 17 and projecting radially inwardly perpendicular to longitudinal axis 15 of the container, and a plurality of second annular ridges 19 disposed on the inner surface of the cover and also projecting radially inwardly perpendicular to longitudinal axis 15, are adapted for interlocking engagement with edge 14 of rim 13 of cylindrical body member 11 for securing cover 17 on the container. Second annular ridges 19 are vertically spaced apart from first annular ridge 18 and are disposed below ridge 18 so as to form a plurality of spaces 20 on the inner surface of cover 17 between ridges 18 and 19 which receive edge 14 of rim 13 when cover 17 is disposed on cylindrical body member 11, thereby detachably securing the cover on the body member. Ridges 18 and 19 are integrally formed with cover 17, preferably from plastic material by means of an injection molding process.

In the foregoing specification, the invention has been described with reference to a specific exemplary embodiment thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. A container for storing frozen foods such as ice cream and the like, comprising:

a base, a cylindrical body member joined to said base, a rim disposed at the end of said cylindrical body member opposite said base and including an edge projecting radially outwardly from said rim perpendicular to the longitudinal axis of said container, a cover adapted for slidable positioning over said rim, and means, disposed on the inner surface of said cover and adapted for interlocking engagement with said edge of said rim, for securing said cover on said cylindrical body member, said securing means comprising a first annular ridge disposed on the inner surface of said cover and projecting radially inwardly perpendicular to the longitudinal axis of said container, and a plurality of second annular ridges disposed on the inner surface of said cover and projecting radially inwardly perpendicular to the longitudinal axis of said container, said plurality of second annular ridges being spaced apart from said first annular ridge so as to form a plurality of spaces on the inner surface of said cover between said first and second ridges for receiving said edge of said rim when said cover is disposed on said cylindrical body member and thereby securing said cover on said body member.

2. The container recited in claim 1, wherein said plurality of second annular ridges are disposed below said first annular ridge.

3. The container recited in claim 1, wherein said rim has a diameter which is greater than that of said cylindrical body member.

4. The container recited in claim 1, wherein said base member is annular in shape and includes an inwardly recessed central portion.

5. The container recited in claim 1, further comprising a plurality of circumferentially spaced apart rib members disposed on the inner surface of said cylindrical body member parallel to the longitudinal axis of said container.

6. The container recited in claim 5, wherein said base, rib members and said rim are integrally formed with said cylindrical body member, and wherein said first and second annular ridges are integrally formed with said cover.

7. The container recited in claim 6, wherein said base, cylindrical body member, rim, cover, rib members and annular ridges are fabricated of plastic.

* * * * *